US005926197A

United States Patent [19]

Kessler

[11] Patent Number: 5,926,197

[45] Date of Patent: Jul. 20, 1999

[54] LINERLESS LABEL WEB, METHOD OF MAKING SAME AND METHOD OF CLEANING AND USING A PRINT HEAD

[75] Inventor: John R. Kessler, Dayton, Ohio

[73] Assignee: Monarch Marking Systems, Inc., Dayton, Ohio

[21] Appl. No.: 08/583,251

[22] Filed: Jan. 5, 1996

[51] Int. Cl.[6] ..... B41J 29/17

[52] U.S. Cl. ..... 347/171; 347/221; 400/701; 400/702

[58] Field of Search ..... 347/221, 171; 400/701, 702

[56] References Cited

U.S. PATENT DOCUMENTS

| | | | |
|---|---|---|---|
| 4,369,456 | 1/1983 | Cruz-Uribe et al. . | |
| 4,590,497 | 5/1986 | Shibata et al. . | |
| 4,851,383 | 7/1989 | Fickenscher et al. | 503/200 |
| 4,899,947 | 2/1990 | Fogle et al. . | |
| 5,086,987 | 2/1992 | Shieh . | |
| 5,292,713 | 3/1994 | Stenzel et al. | 503/226 |

FOREIGN PATENT DOCUMENTS

| | | | |
|---|---|---|---|
| 60-049985 | 3/1985 | Japan . | |
| 60-49985 | 3/1985 | Japan . | |
| 62-297172 | 12/1987 | Japan . | |
| 63-114691 | 5/1988 | Japan | 347/221 |
| 63-303779 | 12/1988 | Japan . | |
| 02098476 | 4/1990 | Japan . | |
| 03111076 | 5/1991 | Japan . | |
| 4-173289 | 6/1992 | Japan . | |
| WO9321020 | 10/1993 | WIPO . | |

*Primary Examiner*—Huan Tran
*Attorney, Agent, or Firm*—Joseph J. Grass

[57] ABSTRACT

There is disclosed a release-coated linerless label web which includes a cleaner and a printable portion. The web can be threaded into contact with a thermal print head and the cleaner can clean the print head and thereafter the web is advanced to printed on a series of labels. The cleaner can be comprised in one embodiment of a plurality of lines of perforation cuts which roughen the surface of the web sufficiently to clean the print head upon many contact of the web with the print head. In another embodiment the cleaner is provided by embossments. In yet another embodiment the cleaner is provided by straining the web. Methods of making and using the web are also disclosed.

22 Claims, 2 Drawing Sheets

THERE
HERE

LINERLESS LABEL WEB, METHOD OF MAKING SAME AND METHOD OF CLEANING AND USING A PRINT HEAD

BACKGROUND OF THE INVENTION

1. Field of the Invention

This invention relates to the art of linerless labels, methods of making same and to method of cleaning and using a thermal print head.

2. Background of the Invention

It is known to thermally print on plain paper or thermally coated paper tags and labels in a thermal printer. In many such printers, a tag or label web is moved while in contact with a stationary thermal print head. The print head remains clean enough in normal use to print a large number of tags or labels. An example of such a printer is found in U.S. Pat. No. 4,899,947 granted Feb. 13, 1990 to Ronald L. Fogle et al.

It has been found that a thermal print head used to print on release coated linerless webs causes streaking especially near the beginning of the printing operation. This streaking is caused by dirt, dust, debris, adhesive and the like that accumulates on the print head. This streaking tends to diminish with use of a linerless web having perforation cuts dividing the web into labels. However, until such time as the streaking diminishes to an acceptable level, streaked tags or labels result. This streaking is especially detrimental where parallel bars of a bar code are printed. For example, if a streak occurs at a place where the bar is printed, the resulting bar may be narrower than required and the adjacent space will then be correspondingly wider than required.

It is known to protect the tag or label web by providing a protective outer wrap as disclosed in U.S. Pat. No. 5,086,987 granted Feb. 11, 1992 to Roung-Min Shieh.

It is known that thermal print heads can be cleaned using special cleaning strips which are advanced between and in pressure contact with the print head and the platen.

It is also known to manually clean thermal print heads using cotton swabs containing alcohol.

SUMMARY OF THE INVENTION

The invention relates to an improved web capable of cleaning the print head and on which printing can subsequently be done using the cleaned print head.

According to the invention, a cleaner is located downstream of a printable portion. Preferably the cleaner and the printable portion use a non-piece web for both the cleaner portion and the printable portion.

In accordance with an embodiment of the invention, there is provided a web including a marginal end portion having a cleaner for a thermal print head, and a printable portion connected to the marginal end portion for receiving thermally printed data.

In accordance with a feature of the invention, linerless printable pressure sensitive label material is roughened at the marginal end portion and this roughening cleans the print head before the remainder of the web is printed.

According to the invention, the web to be printed on has a leading section referred to as a cleaner comprised of a section of increased frictional resistance over the friction offered by the silicone coated web itself.

A specific embodiment of the invention includes a web of linerless pressure sensitive label material wound into a roll. The web terminates at an outer free end. A marginal end portion is provided by a outer protective wrap. There is a tear line adjacent the outer wrap so that the outer wrap can be readily torn off just before use. The marginal end portion includes a partial wrap adjacent the outer wrap which is roughened by numerous lateral lines of perforation cuts. This roughening cleans the thermal print head. The remainder of the web can thus be printed upon using the cleaned thermal print head.

In another embodiment the cleaner is comprised of a series of embossments, and in yet another embodiment the cleaner is comprised of a strained section caused by stressing the web, as by causing that section to undergo a sharp change in direction.

The invention also includes a method of cleaning a thermal print head and using the thermal print head to print in cooperation with a platen to print on a web. The method comprises providing a web having a cleaner and a printable area, threading the web between the print head and the platen so that the printable area is upstream of the cleaner, advancing the web to bring the cleaner into cooperation with the print head to clean the print head, and further advancing the web and printing on the printable area only after the print head has been cleaned by the cleaner. The cleaner is preferably disposed between a protective outer wrap of the web and a printable area. The method preferably includes separating the outer wrap from the remainder of the web.

It is also a feature of the invention to provide that the laterally extending perforation cuts are comprised of elongated cuts separated by intervening lands, wherein the elongate Cuts and lands of alternate lines of perforation are staggered so that the lands of one line of perforation cuts are longitudinally aligned with elongate cuts of the adjacent lines of perforation cuts.

It is also a feature of the invention to stagger the embossments so that the embossments of one line are longitudinally aligned with embossments of the adjacent lines.

DETAILED DESCRIPTION OF THE PREFERRED EMBODIMENT

Figures 1, 2, 3, 4:
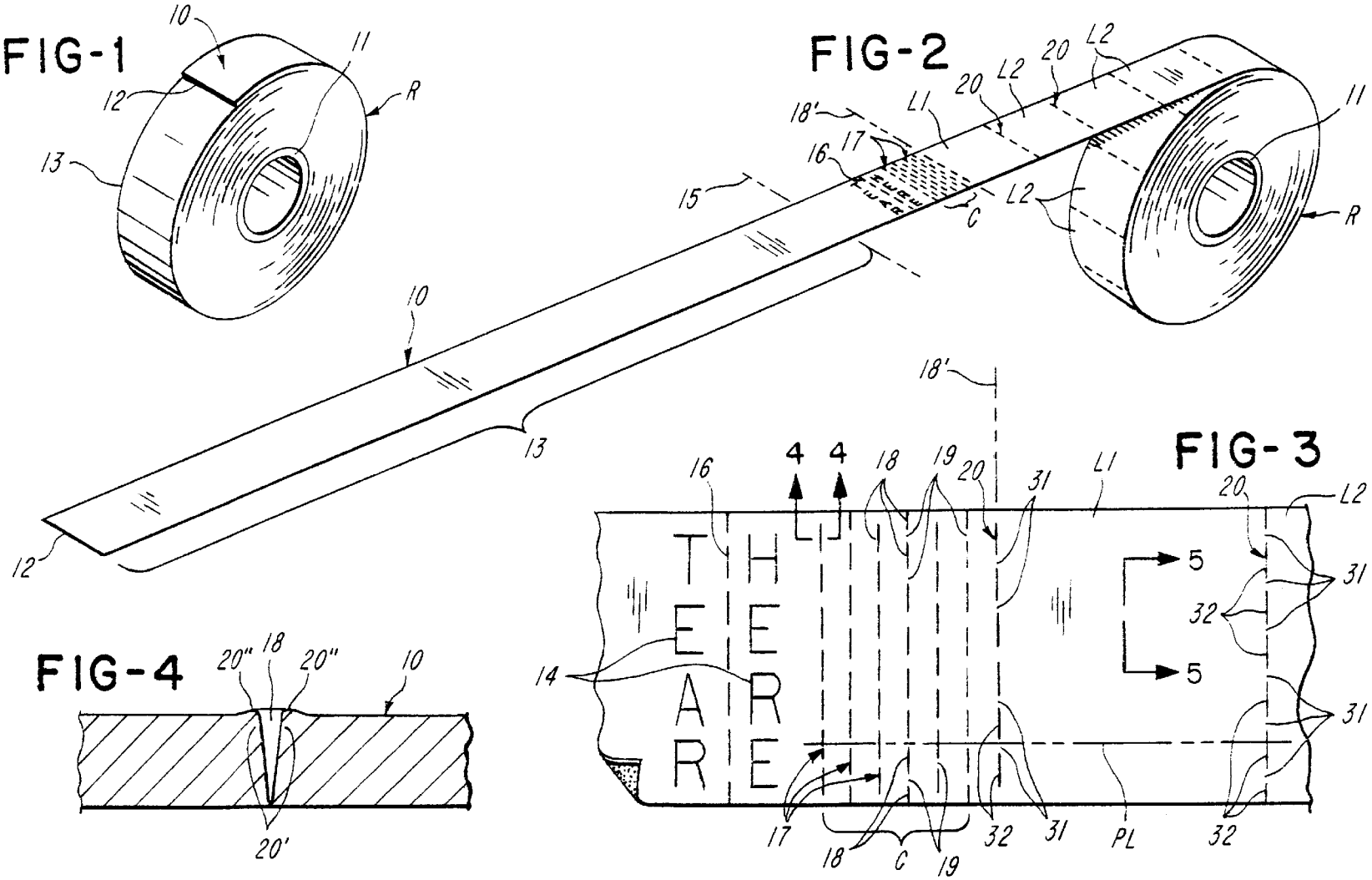
FIG. 1 is a perspective view of a web roll embodying the invention.
FIG. 2 is a perspective view of the web roll showing a partially unraveled portion.
FIG. 3 is an enlarged top plan view of a portion of the web shown in FIG. 2.
FIG. 4 is an enlarged view taken along line 4—4 of FIG. 3 showing the manner in which a perforation cut roughens the surface of the web.

With reference to FIG. 1, there is shown a web 10 which has been wound into a roll R. The roll R is shown to have a core 11. The web 10 terminates at an outer terminal free end 12. The web 10 on the roll R has an outer protective wrap 13.

With reference to FIG. 2, the outer wrap 13 is shown to be free of any marks or perforation cuts. The outer wrap 13 is protective in that it keeps the remainder of the web 10 clean. The outer wrap 13 is shown to terminate at a line indicated at 15 which marks the beginning of the adjacent wrap. The length of the outer wrap 13 is, of course, dependent upon the diameter of the roll R. The web 10 also has a tear line 16 extending laterally across the web 10. There are printed instructions 14 such as "TEAR HERE" printed adjacent the tear line 16 so that the user will readily know where to tear off the outer wrap 13 plus preferably a little bit more. In accordance with one embodiment of the invention, a cleaner C is provided by a plurality of closely longitudinally spaced lateral lines of perforation cuts 17 in the web 10. The cuts 17 comprise a cleaner C which is upstream of the outer wrap 13. The first or leading label L1 capable of being printed starts at line 18'. The second and subsequent labels are indicated at L2.

FIG. 3 shows a portion of the adjacent wrap in greater detail. It is seen that the perforation cuts 17 are provided by knife cuts 18 spaced apart by lands 19. The perforation cuts 17 are made along closely spaced parallel lines extending laterally across the web 10.

The labels L1 and L2 are defined by perforation cuts 20 extending laterally across the web 10 at equally longitudinally spaced intervals. The labels L1 and L2 are considered to be connected at the perforation cuts 20. The labels L1 and L2 are considered to be upstream of the cleaner C.

FIG. 4 illustrates a perforation cut 18. As shown, the material forming the web has been cammed apart, and indeed, the adjacent material 20' is compressed and there is some protrusion or bunching up of the material as indicated at 20". This provides localized hardness of the web material adjacent the knife cut 18, and constitutes increased friction and surface roughness. This results in cleaning action against the print head 27 as the web 20 moves relative to the print head 27.

Figure 5:
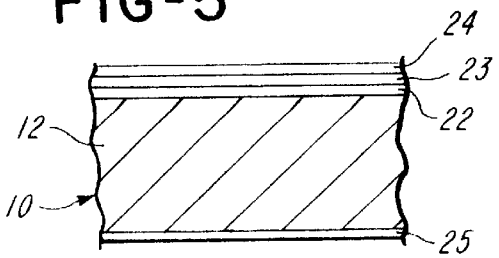
FIG. 5 is an enlarged sectional view taken generally along line 5—5 of FIG. 3.

With reference to FIG. 5, the web 10 is shown to be comprised of a web of paper 21 having a thermal coating 22. There is a barrier coating 23 on the thermal coating 22 and there is a release coating 24 comprised of silicone on the barrier coating 23. There is a coating of pressure sensitive adhesive 25 on the underside of the paper web 12.

Figure 6:
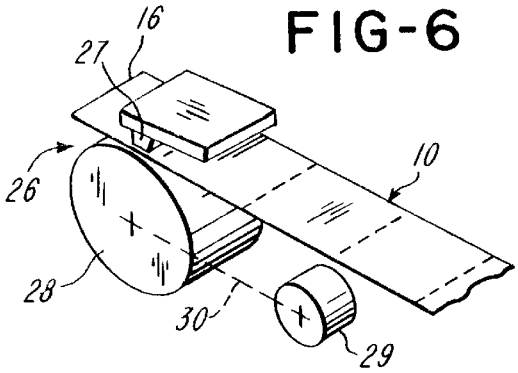
FIG. 6 is a diagrammatic perspective view showing use of the web in a thermal printer.

FIG. 6 shows a thermal printer 26 having a thermal print head with a laterally extending line of printing elements cooperable with a platen 28 in the form of a roll. The platen 28 is shown to be driven by an electric motor 29 suitably coupled as indicated at 30. The roughening of the surface of the web by multiple lines of perforation cuts 17 is a simple and effective way to clean the print head. In using the roll R, the outer wrap 13 is unwound to beyond the tear line 16. The web 10 is torn along the tear line 16 so that the outer wrap and preferably a little bit more of the web 10 are removed. The free end of the web 10 now exists along the line 16 as shown in FIG. 6. Thereupon, the web 10 is threaded between the print head 27 and the platen 28, and the platen 28 is rotated to advance the cleaner C in contact with the print head 27. Such contact of the cleaner C with the print head 27 cleans the print head so that when the leading label L1 and subsequent labels L2 are printed, streaks on the printable surface of the web 10 will be avoided.

It should be noted that adjacent lines of perforation cuts 17 are staggered so that the lands of one line of perforation cuts 17 are longitudinally aligned with the lands 18 of the adjacent line or lines of perforation cuts 17. This is illustrated by longitudinal phantom line PL which shows the staggered knife cuts 18 and 32. In this way there are no gaps in the cleaning of the print head 27 as would be the case if the lands 19 were all longitudinally aligned and the knife cuts 18 were all longitudinally aligned. The lines of perforation cuts 20 which form the labels L1 and L2 are also staggered in that the lands 31 of adjacent lines 20 of perforation cuts are offset in an alternating pattern. This is best seen in FIG. 3 which shows lands 31 of one line 20 longitudinally aligned with perforation cuts 32 of the adjacent line 20. The lines of perforation cuts 17 help to maintain the print head in the clean state so that build up of dirt, debris and the line do not become a problem.

Figure 7:
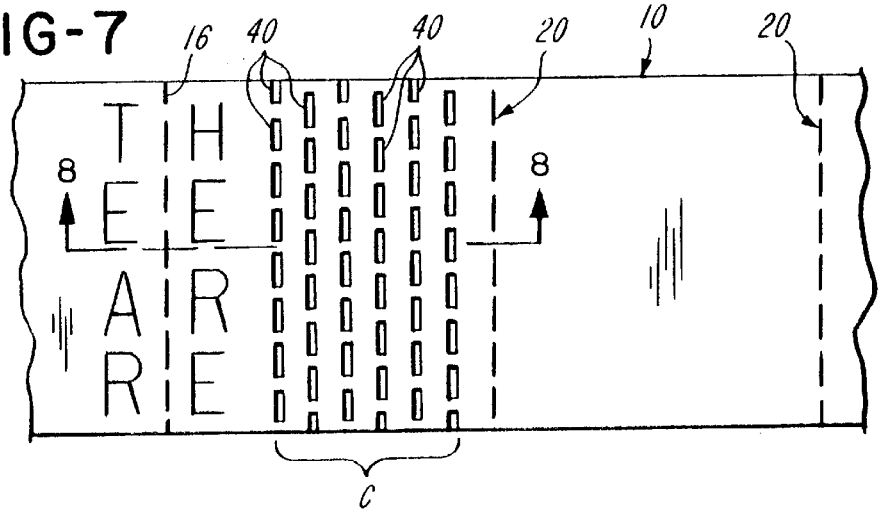
FIG. 7 is a top plan view similar to FIG. 3, but showing an alternative embodiment of a portion of the web, wherein embossments have been made in the web.
Figure 8:
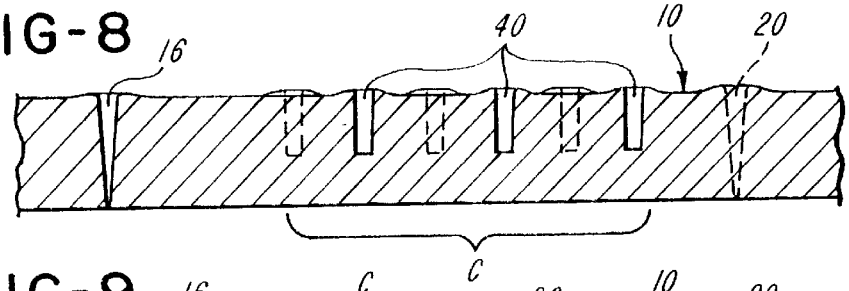
FIG. 8 is a sectional view taken along line 8—8 of FIG. 7.

The embodiment of FIGS. 7 and 8 is the same as the embodiment of FIGS. 1 through 6, except that the surface roughness or increased friction is provided by embossments 40 along longitudinally spaced laterally extending lines, as shown. The embossments 40 are shown to be staggered or offset, one line to the other, so that all portions of the print head 27 will be cleaned.

Figure 9:
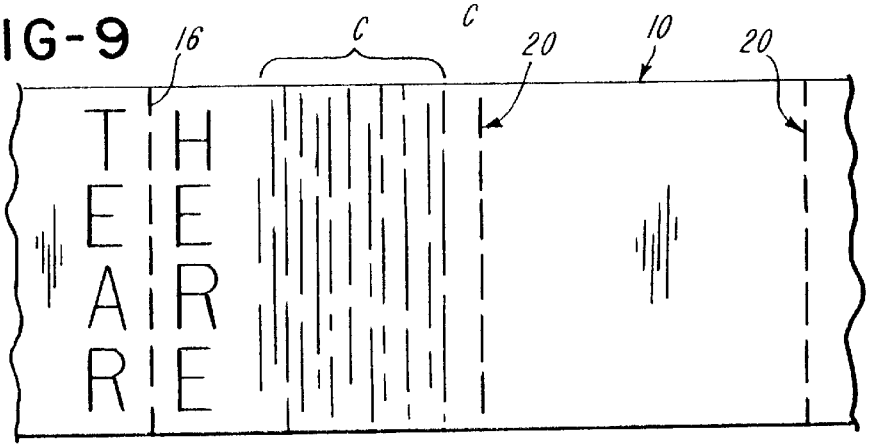
FIG. 9 is a view similar to FIG. 3, but showing yet another embodiment, wherein the surface of the web has been roughened by stressing the web to cause strain in the web.

The embodiment of FIG. 9 is the same as the embodiment of FIGS. 1 through 6, except that cleaner C is formed by causing the material indicated at C to undergo a sharp change in direction, as by passing it at a sharp angle about a turning bar, thereby stressing the web 20 and causing the resultant strain to impart a roughness or resultant strain to enhance surface friction of the web 20 so as to render it capable of cleaning a print head 27 during relative movement of the web 20 in contact with the print head 27.

Other embodiments and modifications of this invention will suggest themselves to those skilled in the art and all such of these as some within the spirit of this invention are included within its scope as best defined by the appended claims.

I claim:

1. A web of linerless pressure sensitive labels in a roll for use in a label printer having a thermal print head, comprising: a longitudinally extending web of label material, one side of the label material web having a surface with a thermal coating, a release coating on the thermal coating to facilitate unwinding of the label material web from the roll, a coating of pressure sensitive adhesive on the other side of the label material web, equally longitudinally spaced laterally extending lines of weakening in the label material web to divide the label material web into connected labels, and a roughened portion of the one side of the label material web to facilitate cleaning of the thermal print head, wherein the roughened portion is provided by deforming or stressing the web.

2. A web as defined in claim 1, wherein the web has a terminal free end, wherein the roughened portion is relatively close to the terminal free end.

3. A web of linerless pressure sensitive labels for use in label printer having a thermal print head, comprising: a longitudinally extending web of label material, wherein the label material web has been wound into a roll, the web having an outer wrap and an adjacent wrap, one side of the label material web having a surface with a thermal coating, a release coating on the thermal coating to facilitate unwinding of the label material web from the roll, a coating of pressure sensitive adhesive on the other side of the label material web, equally longitudinally spaced laterally extending lines of weakening to divide the label material web into labels, a cleaner comprised of a section of increased frictional resistance at said one side of the web to facilitate cleaning of the thermal print head, and wherein the cleaner is only on the adjacent wrap.

4. A web as defined in claim 3, the adjacent wrap being connected to the outer wrap by a lateral tear line of weakening.

5. A web as defined in claim 4, and printed instructions on the label material web adjacent the tear line.

6. A web of linerless pressure sensitive labels for use in a label printer having a thermal print head, comprising: a label material web, equally longitudinally spaced laterally extending lines of weakening in the web to divide the label material web into labels, the label material web having a terminal end, a group of perforation cuts or embossments across at least a portion of the label material, web between the terminal end and the labels to be printed to facilitate cleaning of the thermal print head, the perforation cuts or embossments of the group being spaced longitudinally more closely than the spacing of the lines of weakening.

7. A web of linerless pressure sensitive labels in a roll for use in a label printer having a thermal print head, comprising:

a web of label material, one side of the label material web having a surface with a thermal coating, a release coating on the thermal coating to facilitate unwinding of the label material web from the roll, a coating of pressure sensitive adhesive on the other side of the label material web, longitudinally spaced laterally extending lines of perforation cuts in the label material web to divide the label material web into labels, wherein the lines of perforation cuts are comprised of elongate cuts separated by intervening lands, wherein the elongate cuts and lands of alternate lines of perforation cuts are staggered so that the lands of one line of perforation cuts are longitudinally aligned with elongate cuts of the adjacent lines of perforation cuts.

8. A web for use in a thermal printer having a thermal print head, the web comprising: a cleaner for cleaning a thermal print head, the cleaner being adjacent a free terminal end of the web, a printable portion connected to the cleaner, and the cleaner having a roughened frictional surface provided by deforming the web or by stressing the web.

9. A web for use in a thermal printer having a thermal print head, the web comprising: a marginal end portion having a cleaner for a thermal print head, the cleaner being comprised of a section of increased frictional resistance, the cleaner having a roughened frictional surface provided by deforming the web or by stressing the web.

10. A web as defined in claim 9, a printable portion adjacent the cleaner, wherein the marginal end portion and the printable portion are comprised of a continuous web of printable material.

11. A web of linerless pressure sensitive labels in a roll for use in a label printer having a thermal print head, comprising: a longitudinally extending web of label material, one side of the label material web having a surface with a thermal coating, a release coating on the thermal coating to facilitate unwinding of the label material web from the roll, a coating pressure sensitive adhesive on the other side of the label material web, equally longitudinally spaced laterally extending lines of weakening in the label material web to divide the label material web into connected labels, and a roughened frictional surface provided by deforming the web or by stressing the web.

12. Method of cleaning a thermal print head and using the thermal print head in cooperation with a platen to print on a web, comprising the steps of: providing a web of label material in a roll having a terminal end, one side of the label material web having a surface with a thermal coating, a release coating on the thermal coating to facilitate unwinding of the label material web from the roll, a coating of pressure sensitive adhesive on the other side of the label material web, the label material web having one or more printable areas for receiving data printed by a thermal print head, said one side of the label material web having a roughened area between the printable area or areas and the terminal end, the roughened area being provided by deforming the web or by stressing the web, threading the label material web between the print head and the platen, advancing the web to bring the roughened area into contact with a print head to clean the print head, and further advancing the label material web to bring the printable area or areas into printing cooperation with the print head and printing on the printable area only after the print head has been cleaned by the roughened area.

13. Method of cleaning a thermal print head and using the thermal print head in cooperation with a platen to print on a web, comprising the steps of: providing a web of labels which has been wound into a roll, one side of the web having a surface with a thermal coating, a release coating on the thermal coating to facilitate unwinding of the label roll, a coating of pressure sensitive adhesive on the other side of the web, the web having an outer wrap, a cleaner and a printable area, the cleaner being disposed between the outer wrap and the printable area the cleaner having a roughened frictional surface provided by deforming the web or by stressing the web, separating the outer wrap from the remainder of the web, threading the cleaner between the print head and the platen so that the cleaner can clean the print head before the printable area cooperates with the print head, advancing the web into printing cooperation with the web at the printable area and printing on the web at the printable area.

14. Method of cleaning a thermal print head and using the thermal print head in cooperation with a platen to print on a web, comprising the steps of: providing a printable silicone coated web in roll form in which a leading portion has been strained to enhance its web-cleaning characteristics, threading the web between the print head -and the platen so that the strained leading portion contacts the print head, advancing the web to bring the strained portion into cooperation with the print head to clean the print head, and further advancing the web and printing on the web only after the print head has been cleaned.

15. Method of making a web for cleaning a print head of a thermal printer and for printing on a printable portion of the web, comprising the steps of: providing a printable linerless silicone coated pressure sensitive adhesive web of record members, and stressing a portion of the web to provide a cleaner adjacent a printable portion of the web.

16. Method of making a web for cleaning a print head of a thermal printer and for printing on a printable portion of the web, comprising the steps of: providing a printable linerless silicone coated pressure sensitive adhesive web of record members, and deforming a portion of the web to provide a cleaner adjacent a printable portion of the web.

17. Method of making a web for cleaning a print head of a thermal printer and for printing on a printable portion of the web, comprising the steps of: providing a printable linerless silicone coated pressure sensitive adhesive web of record members, and roughening the surface of a portion of the web by deforming the web or by stressing the web to provide a cleaner adjacent a printable portion of the web.

18. A web of linerless pressure sensitive labels in a roll for use in a label printer having a thermal print head, comprising: a longitudinally extending web of label material, one side of the label material web having a printable surface, a release coating on said one side of the label material web, a coating of pressure sensitive adhesive on the other side of the label material web, equally longitudinally spaced laterally extending lines of weakening in the label material web to divide the label material web into connected labels, and a roughened portion on the one side of the label material web facilitating cleaning of the thermal print head, the roughened portion being provided without adding any material to the web.

19. A web of linerless pressure sensitive labels in a roll for use in a label printer having a thermal print head, comprising: a web of label material, one side of the label material web having a printable surface, a release coating on said one side of the label material web, a coating of pressure sensitive adhesive on the other side of the label material web, longitudinally spaced laterally extending lines of perforation cuts in the label material web to divide the label material web into labels, wherein the lines of perforation cuts are comprised of elongate cuts separated by intervening lands, wherein the elongate cuts and lands of alternate lines of perforation cuts are staggered so that the lands of one line of perforation cuts are longitudinally aligned with elongate cuts of the adjacent lines of perforation cuts.

20. A web of linerless pressure sensitive labels in a roll for use in a label printer having a thermal print head, comprising: a longitudinally extending web of label material, one side of the label material web having a printable surface, a release coating on said one side of the label material web, a coating of pressure sensitive adhesive on the other side of the label material web, equally longitudinally spaced laterally extending lines of weakening in the label material web to divide the label material web into connected labels, and a roughened surface provided by deforming the web or by stressing the web to facilitate cleaning of the thermal print head.

21. Method of cleaning a thermal print head and using the thermal print head in cooperation with a platen to print on a web, comprising the steps of: providing a web of label material in a roll having a terminal end, one side of the label material web having a printable surface, a release coating on said one side of the label material web, a coating of pressure sensitive adhesive on said other side of the label material web, the label material web having one or more printable areas for receiving data printed by a thermal print head, said one side of the label material web having a roughened surface provided by deforming the web or by stressing the web, threading the label material web between the print head and the platen, advancing the web to bring the roughened surface into contact with a print head to clean the print head, and further advancing the label material web to bring the printable area or areas into printing cooperation with the print head and printing on the printable area only after the print head has been cleaned by the roughened area.

22. Method of cleaning a thermal print head and using the thermal print head in cooperation with the platen to print on a web, comprising the steps of: providing a web of labels which has been wound into a roll, one side of the web having a release coating to facilitate unwinding of the label roll, a coating of pressure sensitive adhesive on the other side of the web, the web having an outer wrap, a cleaner and a printable area, the cleaner being disposed between the outer wrap and the printable area and being comprised of a section of increased frictional resistance, and the section of increased frictional resistance being provided by deforming the web or by stressing the web, separating the outer wrap from the remainder of the web, threading the section of the web between the print head and the platen to clean the print head before the printable area cooperates with the print head, advancing the web into printing cooperation with the printable area and printing on the web at the printable area.

* * * * *

UNITED STATES PATENT AND TRADEMARK OFFICE

CERTIFICATE OF CORRECTION

PATENT NO. : 5,926,197

DATED : July 20, 1999

INVENTOR(S) : John R. Kessler

It is certified that error appears in the above-indentified patent and that said Letters Patent is hereby corrected as shown below:

Column 5, line 14, after "material", the comma should be omitted.

Signed and Sealed this

Twentieth Day of March, 2001

Nicholas P. Godici

*Attest:*

NICHOLAS P. GODICI

*Attesting Officer*

*Acting Director of the United States Patent and Trademark Office*